United States Patent [19]

Chung

[11] 4,012,889

[45] Mar. 22, 1977

[54] PACKAGING MACHINE

[75] Inventor: Yun-Hoon Chung, Rossford, Ohio

[73] Assignee: International Automated Machines, Inc., Perrysburg, Ohio

[22] Filed: Dec. 8, 1975

[21] Appl. No.: 638,902

[52] U.S. Cl. ..... 53/183; 222/430; 222/451

[51] Int. Cl.[2] ..... B65B 1/02; B65B 9/02

[58] Field of Search ..... 53/180 R, 180 M, 182 R, 53/182 M, 183; 222/413, 426–430, 451, 453

[56] References Cited

UNITED STATES PATENTS

| | | | |
|---|---|---|---|
| 2,827,742 | 3/1958 | Bursak | 53/180 M |
| 3,404,506 | 10/1968 | Chung | 53/183 X |

*Primary Examiner*—Robert Louis Spruill

*Attorney, Agent, or Firm*—Barnes, Kisselle, Raisch & Choate

[57] ABSTRACT

A machine adapted to form and fill a plurality of different size packages with different amounts of products such as sugar, salt, cream, etc. A metering head on the machine has different size cavities each connected with its own individual supply hopper. All the cavities are filled simultaneously and adapted to discharge their contents simultaneously onto a strip of packaging film which is folded into U-shape to form a plurality of receptacles and then directed between a pair of sealing rolls to form a plurality of different size individual packages.

8 Claims, 15 Drawing Figures

144
147
142
146
148
54
150
13
13
140
138
44
136
14
150
66
48
152
158
160
156
14
14
102
127
124
126
46
120
114
122
118
138
140
152
160

150
152
154
160
156
156

188
202
190
190

PACKAGING MACHINE

This invention relates to a machine for simultaneously forming and filling packages of a plurality of different sizes.

Many products such as sugar, salt, pepper, cream, etc. are packaged for individual use in small envelopes or packets. One such machine for forming packages of this type is illustrated in my U.S. Pat. No. 3,404,506. Individual servings of such products normally very in amounts depending on the product. For example, an individual serving of sugar would normally be greater than an individual serving of salt. Accordingly for economy reasons, such packets vary in size depending upon the specific product contained therein.

Normally, machines for forming and filling such packets are designed to produce packets of one particular size. Thus a salt packaging machine would normally produce smaller packages than a sugar packaging machine.

The present invention has for its primary object the provision of a machine adapted to simultaneously form and fill a plurality of packets with varying amounts of products.

More specifically the present invention contemplates a packaging machine having a product metering head formed with a plurality of vertically extending cavities of different volumes. The differently sized cavities are individually connected with hoppers containing the different products to be packaged. The product is fed by gravity from each hopper into the cavities to fill the same. The size of each cavity is determined in part by its vertical dimension. The vertical dimension of each cavity is in turn determined by upper and lower knife blades which are alternately reciprocated to open and close the upper and lower ends of the cavities and thus in effect trap therebetween a predetermined volume of the product which is discharged from the cavity by gravity when the bottom blades are retracted. Below the outlets of the cavities are located product discharge chutes, the lower ends of which are controlled by a movable trap door. When the trap door opens the products in the discharge chutes are discharged upon a strip of packaging film which is supported on a pair of underlying, tangentially engaged sealing rolls. The metering head assembly which includes the product discharge chutes and the trap door assembly is reciprocated vertically and provided on the lower side thereof with a plurality of film folders in the form of downwardly extending abutments or fingers positioned on at each side of each discharge chute. When the metering head assembly moves downwardly the lower ends of the folders engage the strip of packaging film on the sealing rolls, folds it into a generally V-shaped trough to divide the strip into a plurality of successive compartments and displaces it downwardly between the sealing rolls which form the folded strip into individual packets. The folders in each pair are spaced apart in accordance with the size of the associated cavity and the sealing rolls have a plurality of pairs of sealing ribs thereon which are likewise spaced apart in accordance with the size of the respective cavity.

In the event one or more of the products to be packaged is not of the free flowing type (cream in powdered form for example) the product is fed downwardly from a hopper into its respective cavity and discharge chute by an auger mounted to reciprocate vertically with the metering head assembly. The auger is rotated intermittently in timed relation to its vertical reciprocation to discharge from the lower end thereof successive changes of the product, the amount of which is accurately controlled by the extent of the successive increments of angular rotation of the auger.

All of the blades controlling the upper ends of the cavities are reciprocated simultaneously and all of the blades controlling the lower ends of the cavities are reciprocated simultaneously in synchronism with the raising and lowering of the metering head assembly. Reciprocation of the upper and lower blades is controlled by a pair of continuously rotating cams on the metering head assembly which actuate a pair of cam followers. One cam follower is connected by suitable linkage to all of the upper blades and the other cam follower is connected by suitable length to all of the lower blades. In the event an auger is employed in connection with one or more cavities it is operated in synchronism with the blades. Thus with the packaging machine according to the present invention accurately metered charges of differing amounts are simultaneously discharged onto a strip of packaging film which is simultaneously being formed into a plurality of individual packets of different sizes.

Other objects and advantages of the present invention will become apparent from the following description and drawings on which:

Figure 5:
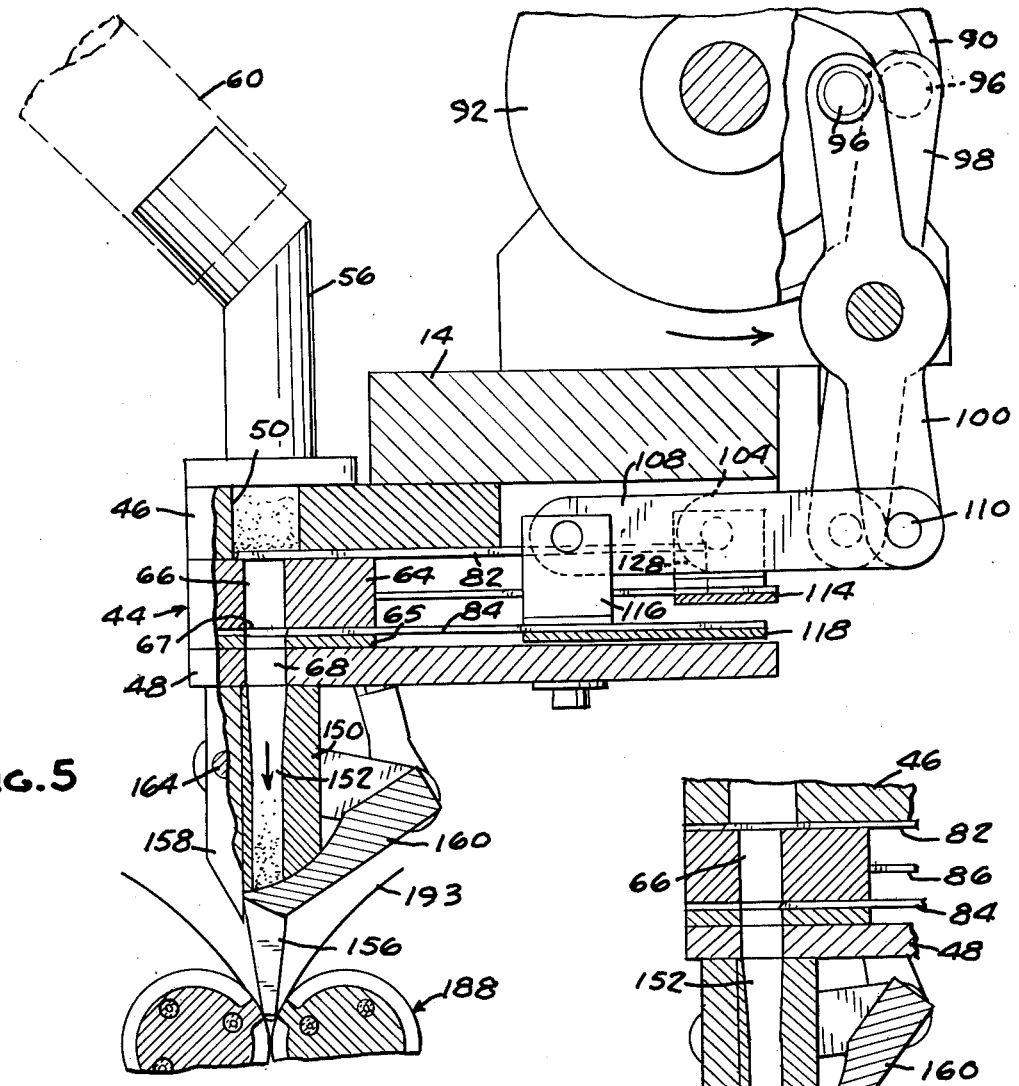
FIG. 5 is a sectional view along the line 5—5 in FIG. 2.
Figure 7:
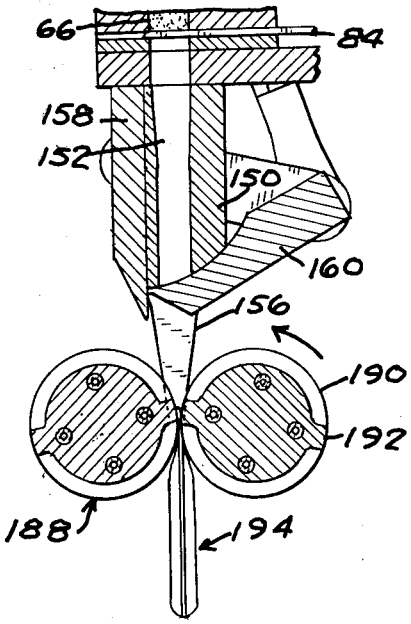
Figure 7A:
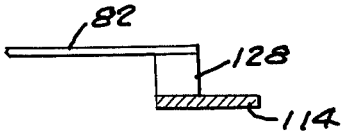

FIG. 7*a* is a fragmentary view of the knife blade controlling the upper end of the cavity illustrated in FIG. 5.

Figure 2:
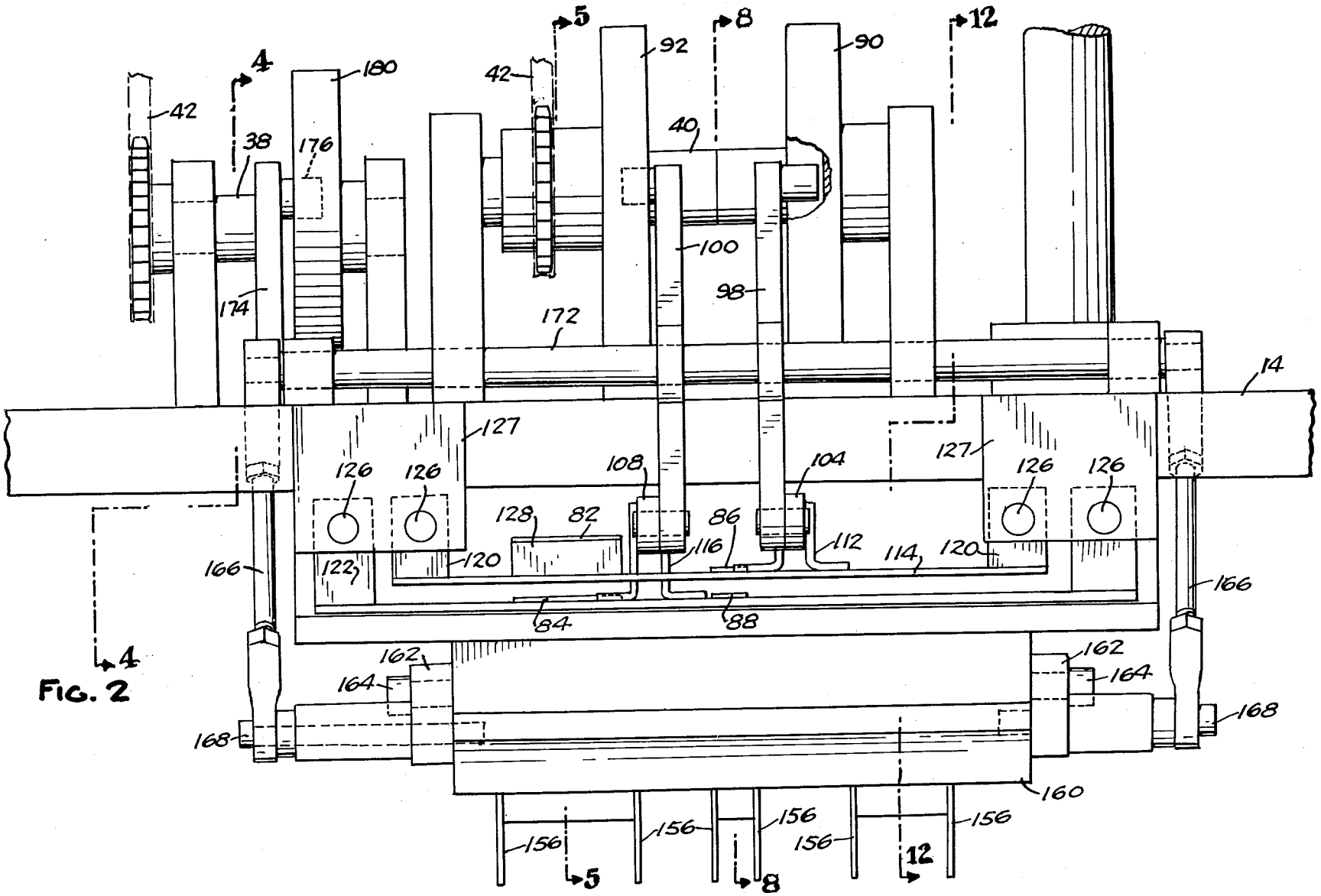
FIG. 2 is a fragmentary side elevational view of a portion of the machine illustrated in FIG. 1 as viewed from the opposite side thereof.
Figure 8:
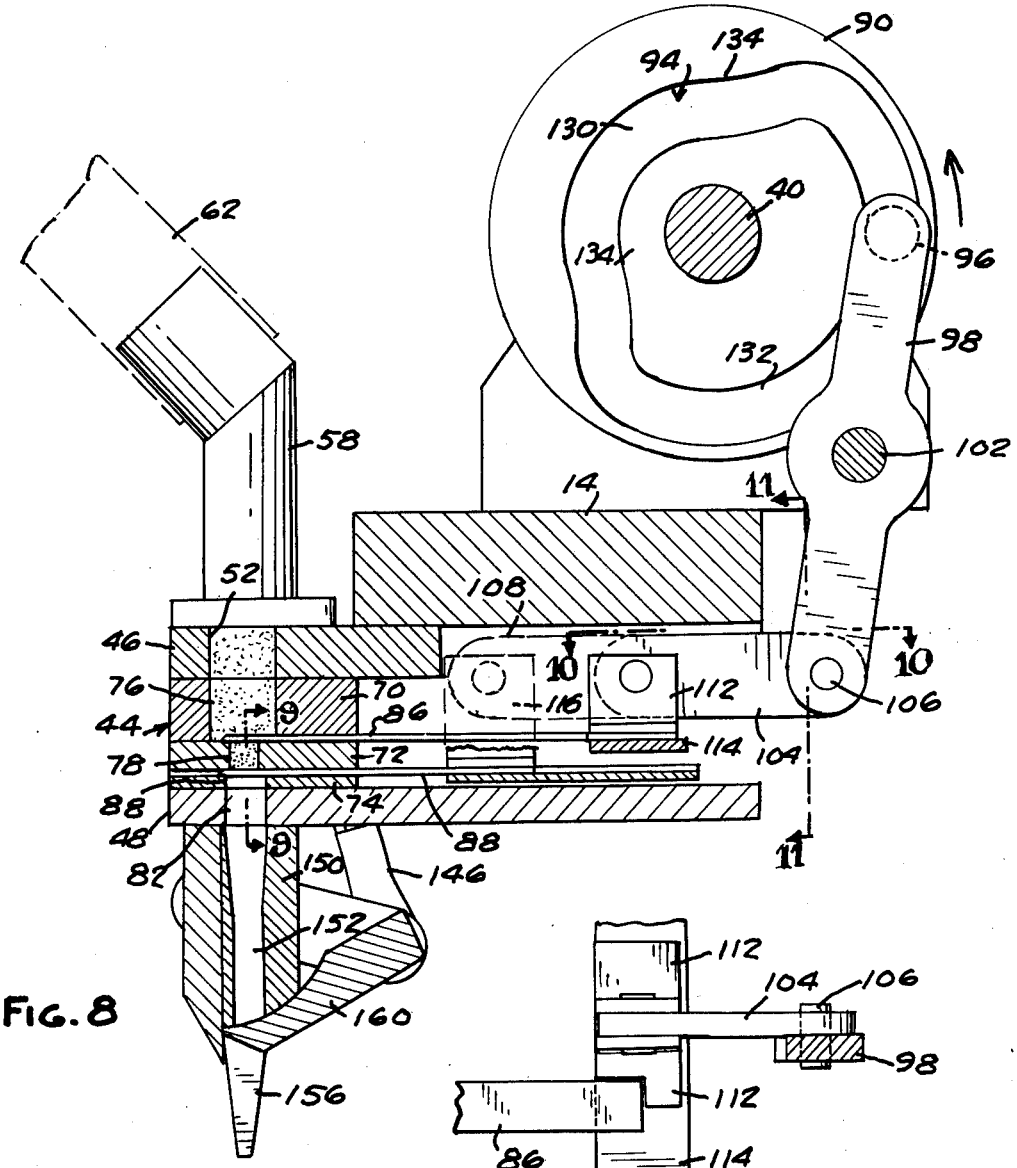

FIG. 8 is a sectional view along the line 8—8 in FIG. 2.

Figure 9:
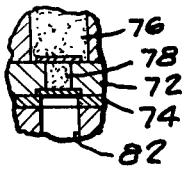

FIG. 9 is a sectional view along line 9—9 in FIG. 8.

Figure 10:
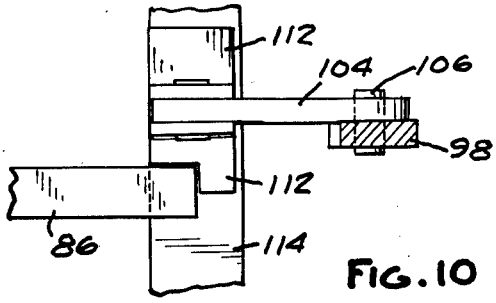

FIG. 10 is a sectional view along line 10—10 in FIG. 8.

Figure 11:
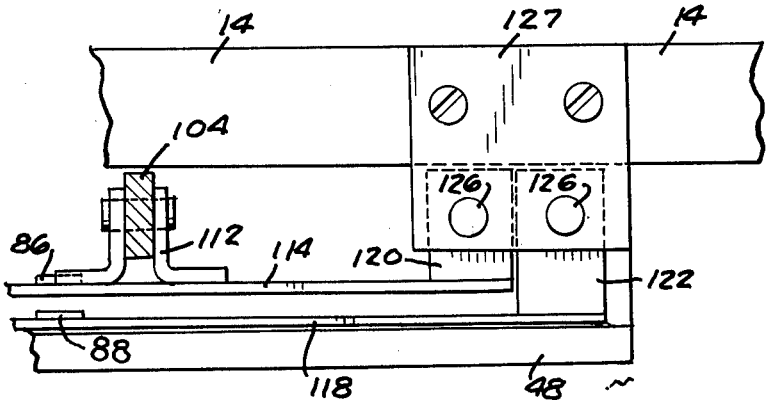

FIG. 11 is a sectional view along line 11—11 in FIG. 8.

Figures 12, 13, 14:
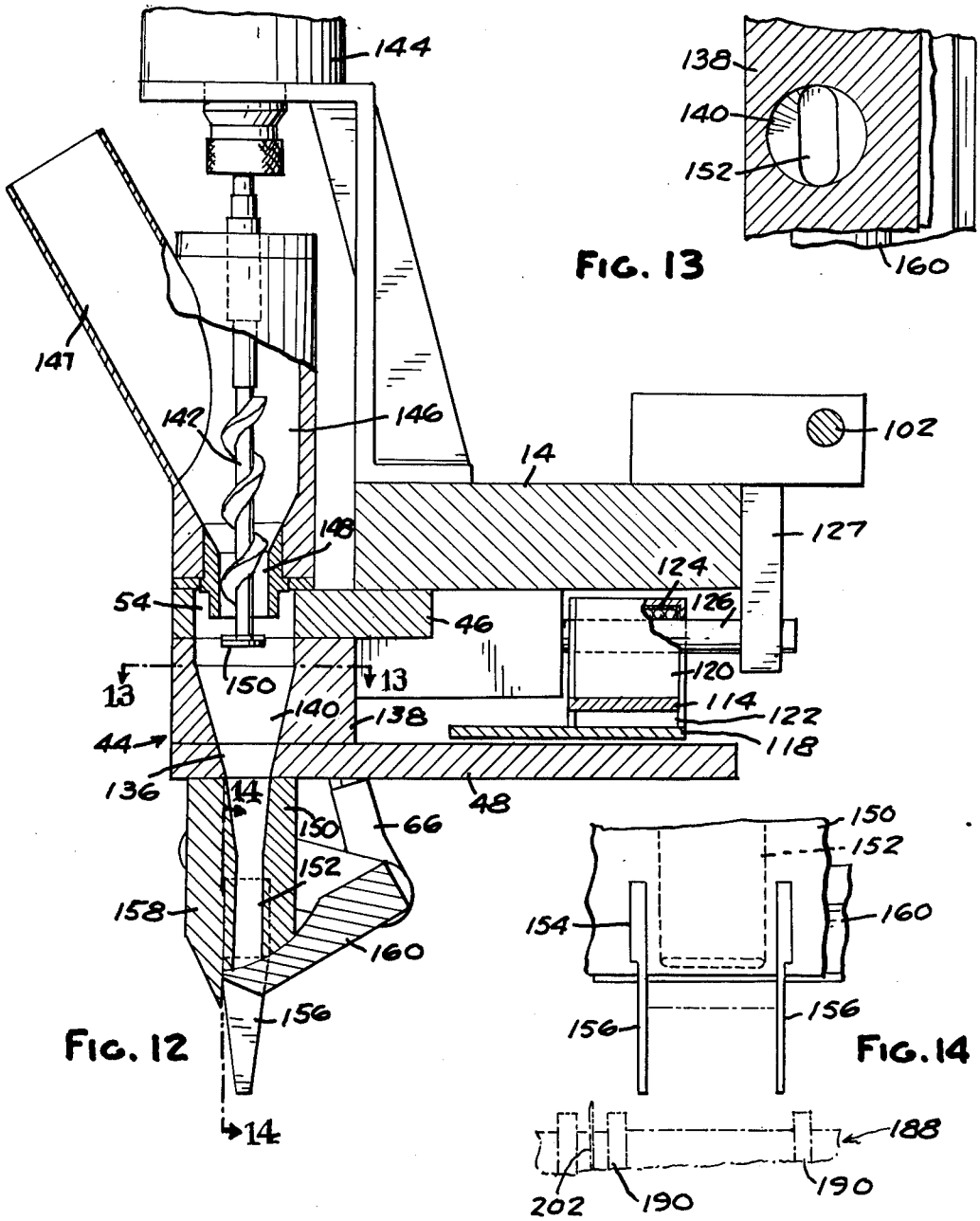

FIG. 12 is a sectional view along line 12—12 in FIG. 2.

FIG. 13 is a sectional view along line 13—13 in FIG. 12.

FIG. 14 is a sectional view along line 14—14 in FIG. 12.

Figure 1:
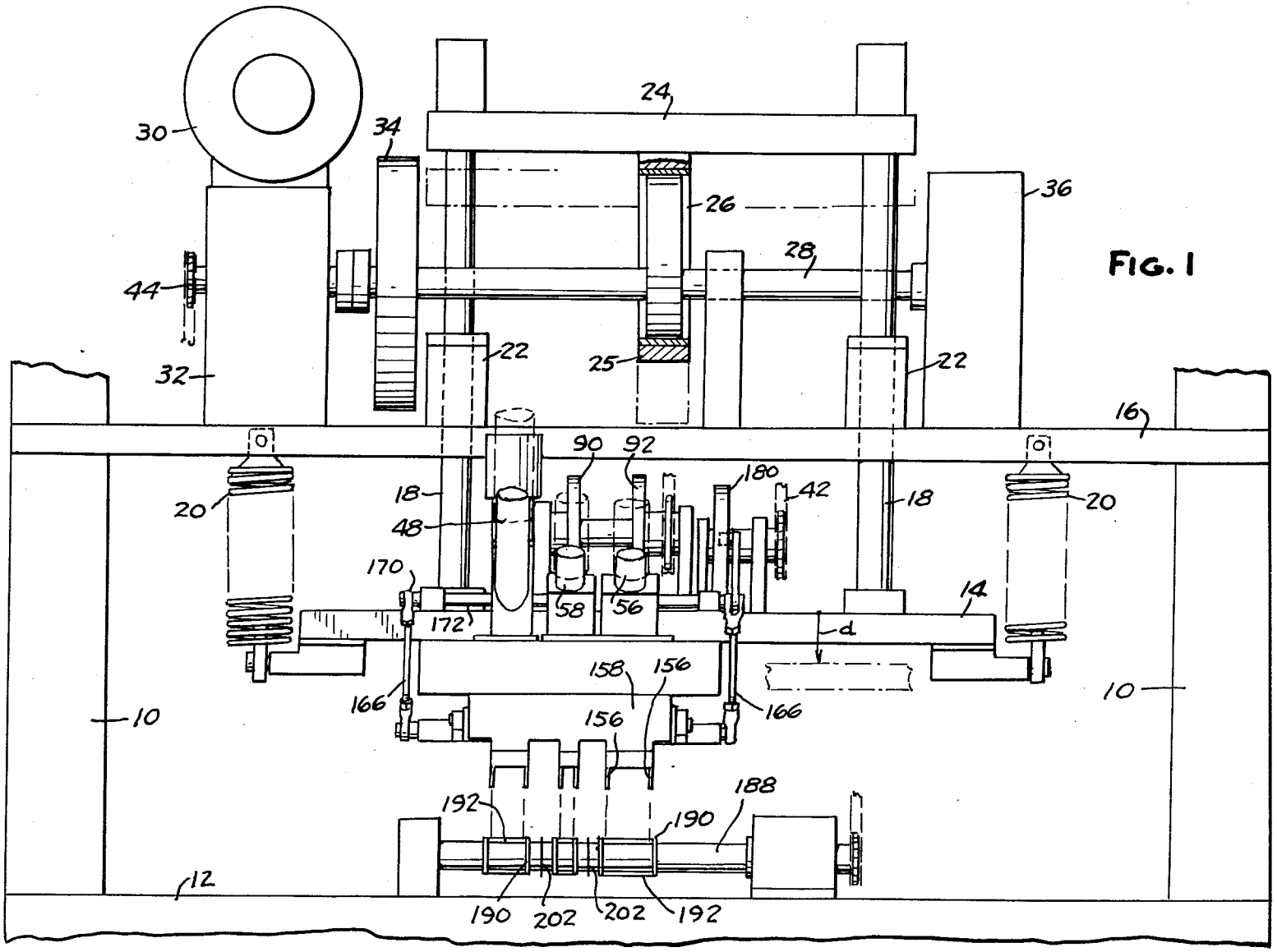
FIG. 1 is a fragmentary elevational view of the machine as viewed from the hopper side thereof.

Referring to FIG. 1, the machine includes a structural frame generally designated 10 which includes a base plate 12 and a fixed upper support plate 16. An intermediate plate 14 is guided for vertical movement on support plate 16 by a guide pins 18. Plate 14 is urged upwardly by a pair of tension springs 20. Pins 18 are guided for vertical movement in a pair of bushings 22 on plate 16. The upper ends of pins 18 are interconnected by a cross bar 24 having a shoe 25 thereon which encloses a trapped cam 26. The assembly of plate 14, cross bar 24 and shoe 25 is urged upwardly against a cam 26 by springs 20. Cam 26 is keyed to a shaft 28 which is rotated by a motor 30 through a gear transmission 32. A heavy flywheel 34 is keyed to shaft 28. Shaft 28 is also connected to a brake assembly 36. With the above described arrangement when shaft 28 is rotated plate 14 is reciprocated vertically through the distance designated *d* in FIG. 1.

Referring now to FIG. 2 a pair of horizontally disposed shafts 38, 40 are journaled for rotation on support plate 16. Each of these shafts is rotated continuously at the same speed by means of similar sprocket-chain drives 42 which are in turn driven by a chain drive 44 from gear transmission 32 in a conventional manner through a jack shaft carried by a suitable pivotally supported arms or links (not shown).

Referring now to FIGS. 4, 5, 8 and 12 there is mounted on the lower side of plate 14 a metering head assembly 44. Metering head 44 includes an upper plate 46, a lower plate 48 and a plurality of spacers therebetween. In the embodiment illustrated upper plate 46 is formed with three openings spaced along the length thereof. One of the openings, designated 50, is illustrated in FIG. 5. The second opening, designated 52, is illustrated in FIG. 8 and the third opening, designated 54, is illustrated in FIG. 12. Openings 50, 52 communicate with vertical conduits 56, 58 respectively, mounted on the top side of plate 46. Conduits 56, 58 communicate at their upper ends with the lower ends of hopper discharge chutes 62. The hoppers (not illustrated) are adapted to supply different products such as sugar and salt to the respective openings.

Referring to FIG. 5 it will be noted that between upper plate 46 and lower plate 48 two spacers 64, 65 formed with through bores 66, 67 which register vertically with opening 50 in top plate 46 and opening 68 in bottom plate 48. Likewise as shown in FIG. 8 between plates 46, 48 there are located three spacers designated 70, 72, 74. These spacers are formed with openings 76, 78, 80, respectively which are vertically aligned with opening 52 in top plate 46 and opening 82 in bottom plate 48. Comparing FIGS. 5 and 8 it will be observed that opening 66 has a greater vertical dimension and also a greater cross section than opening 78. Openings 66, 78 are adapted to form metering cavities for discharging metered amounts of product into the packets being formed as hereinafter more fully described.

At the upper end of cavity 66 there is arranged a horizontally reciprocable blade 82 located between the lower face of plate 46 and the upper face of spacer 64. At the lower end of cavity 66 there is arranged a second horizontally reciprocable blade 84 located between the lower face of spacer 64 and the upper face of spacer 65. Likewise at cavity 78 there are arranged upper and lower horizontally reciprocable blades 86, 88. These blades when reciprocated are adapted to open and close the upper and lower ends of the respective cavities. The respective spacers are grooved to accommodate and guide the upper and lower blades for reciprocation.

The means for reciprocating upper blades 82, 86 comprises a cam 90 on shaft 40 and the means for reciprocating the lower blades 84, 88 comprises a second cam 92 on shaft 40. Each of the cams is formed with a cam track 94 in which a cam follower 96 is engaged. The cam follower for cam 90 is journalled at the upper end of a lever 98 and the cam follower for cam 92 is journalled at the upper end of a second lever 100. Levers 98, 100 are pivotally supported on plate 14 on a common axis as at 102. At its lower end lever 98 is pivotally connected to a link 104 as at 106 and similarly lever 100 is pivotally connected at its lower end to a link 108 as at 110. The other end of link 104 is pivotally connected as by brackets 112 with an upper cross bar 114 while the other end of link 108 is pivotally connected as by brackets 116 with a lower cross bar 118. It will be observed that link 108 is substantially longer than link 104. A pair of guide blocks 120 are mounted on the opposite ends of cross bar 114 and a similar pair of guide blocks 122 are mounted on the opposite ends of cross bar 118. Each of these guide blocks is provided with a ball bushing 124 slidably guided on horizontally disposed guide pins 126 mounted on support plates 127. Thus cross bars 114, 118 are supported for horizontal reciprocation toward and away from the row of cavities in the metering head. As seen in FIGS. 2, 5 and 8 the outer ends of blades 84, 88 are mounted directly on the lower cross bar 118. The vertical spacing between cross bars 114, 118 is such that the upper blade 86 for metering cavity 78 is mounted directly on cross bar 114 (FIG. 8) while the upper blade 82 for the larger metering cavity 66 is mounted on cross bar 114 by means of vertical spacer 128.

Each cam track 94 is provided with diametrically opposite inner and outer arcuate track sections 130, 132, respectively, which are concentric to the axis of shaft 40. These track sections are interconnected at their opposite ends by radially inclined track sections 134. When a cam follower 96 is engaged in track section 132, the blades controlled thereby are in a fully retracted dwell position opening the respective ends of the cavities. When a cam follower 96 is engaged with a track section 134, the blades controlled thereby are horizontally reciprocated. However track 94 of cam 90 is displaced 180° from track 94 on cam 92. Thus as shaft 40 is rotated the upper and lower blades are reciprocated to alternately open and close the upper and lower ends of the respective cavities.

Referring now to FIG. 12 the lower plate 48 of metering head 44 has an opening 136 which registers vertically with opening 54 in top plate 46. Between these two openings there is arranged a spacer block 138 having a conically shaped cavity 140, the upper end of which registers with opening 54 and the lower end of which registers with opening 136. On the top side of plate 46 there is mounted a vertically reciprocable auger 142 which is rotated by a motor 144. Auger 142 extends downwardly into a vertically extending chamber 146 connected at one side thereof by an inclined conduit 147 with a hopper (not shown) adapted to contain a material such as powdered cream which is not free flowing. The lower end of chamber 146 is provided with a bushing 148 having a close fit with the periphery of auger 142. At its lower end auger 142 is provided with a disc 150 adapted to close the lower end of opening 148 when the auger is retracted upwardly. In operation when it is desired to discharge a metered amount of product into the cavity formed by opening 140 motor 144 energized to rotate auger 142 and shift disc 150 downwardly. The amount of product discharged will depend upon the extent of angular rotation of auger 142. Motor 144 is operated intermittently in synchronism with the reciprocation of the blades controlling the remaining cavities in the metering head so as to discharge a metered quantity of the product in opening 140 at approximately the same time that the lower knife blades are retracted to discharge metered quantities of products from the other cavities in the metering head. After a precise amount of rotation, motor 44 is stopped by means of a brake and the auger is retracted to close the lower end of the discharge opening in bushing 148.

Below the row of openings 68, 82, 136 in the lower plate 48 of the metering head there is mounted a bar 150 (FIGS. 2, 5 and 18) having a plurality of vertically extending discharge chutes 152 therein which register with the lower ends of the three cavities in the metering head. On the opposite sides of each discharge chute 152 the forward side of bar 150 is slotted as at 154 to receive downwardly depending fingers 156. As is apparent from the showing in FIGS. 2 and 14, the spacing between each pair of fingers 156 corresponds generally with the amount of product to be discharged through the respective discharge chute 152. Thus fingers 156 associated with cavity 66 are spaced apart a greater distance than are fingers 156 associated with the smaller cavity 78. Fingers 156 are retained in place by a bar 158 which is secured to the front face of and extends downwardly below the lower end of bar 150.

Figures 3, 4:
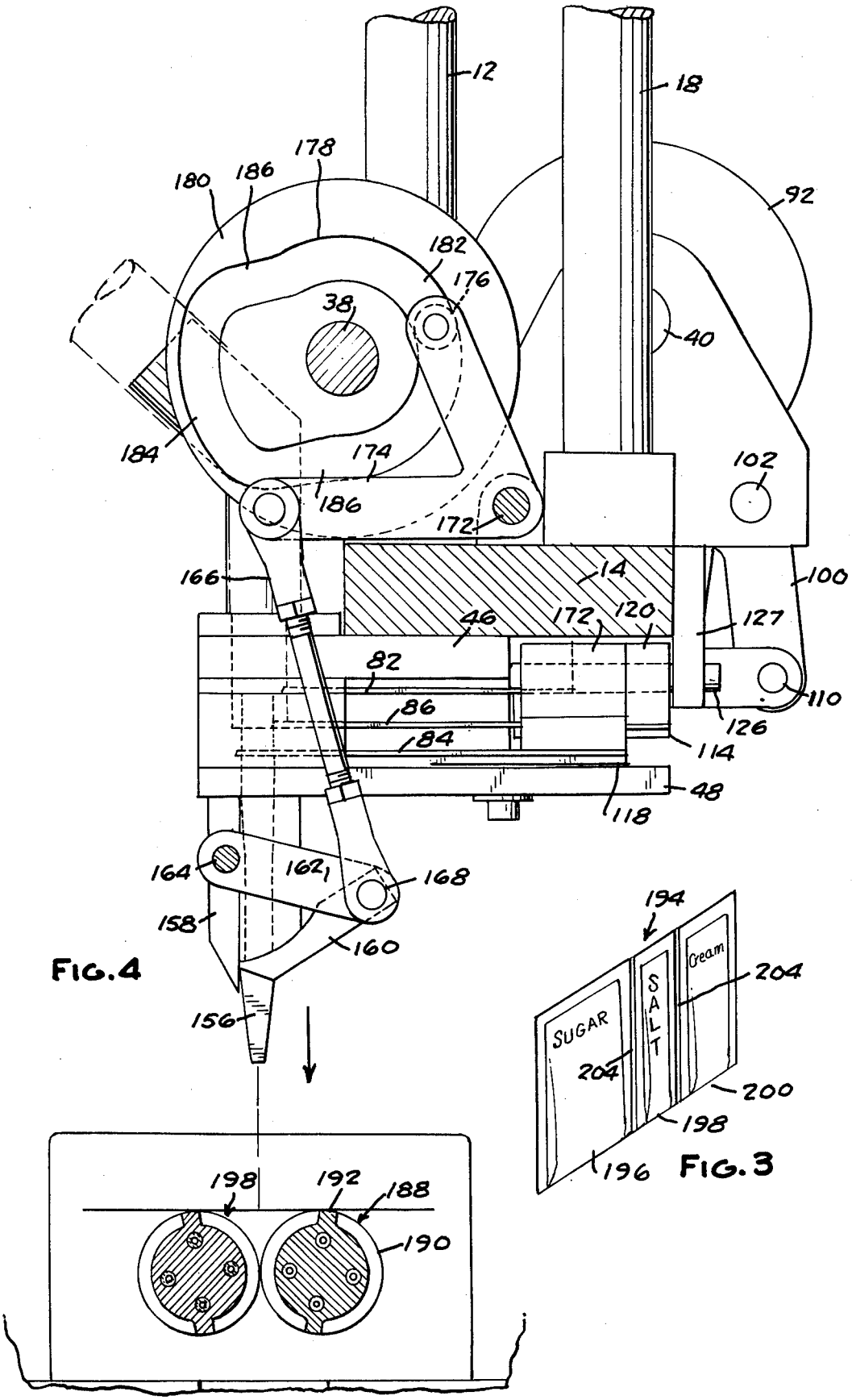
FIG. 3 is a perspective view of a strip of packages produced by the machine.
FIG. 4 is a sectional view along line 4—4 of FIG. 2.

The lower ends of discharge chutes 152 are adapted to be opened and closed by means of a trap door 160. At its opposite ends trap door 160 is fixedly connected to a link 162, FIG. 4. Links 162 are pivotally supported by pintles 164 (FIG. 4). Links 162 are pivotally actuated by links 166. The lower ends of links 166 are connected to links 162 as at 168. The upper end of one link 166, the one shown at the left of FIG. 1, is pivotally connected to a lever 170 keyed to a shaft 172. The other link 166 has its upper end pivotally connected to one arm of bell crank 174 keyed to shaft 172. The other arm of bell crank 174 has a cam follower 176 thereon engaged in a cam track 178 formed in a cam 180 mounted on shaft 38. Cam track 178 has radially inner and outer circular segment track sections 182 184, respectively, interconnected by radially extending track sections 186. The linkage arrangement between trap door 160 and cam follower 176 is such that when cam follower 176 is engaged in the inner circular track section 182 trap door 160 is in the position indicated in FIG. 5, wherein it closes the lower ends of all three discharge chutes 152. When cam follower 176 is engaged with outer track section 184 trap door 160 is displaced to the position shown in FIG. 6 wherein the lower end of chutes 152 are open.

Directly below fingers 156 there is mounted on base plate 12 a pair of tangentially contacting sealing rolls 188. The sealing rolls are divided lengthwise into a plurality of sections, one aligned with each pair of fingers 156. At each section thereof each sealing roll is provided with a pair of circumferential ribs 190 which are spaced apart a distance slightly greater than the spacing between the associated pair of fingers 156. Each section of the two sealing rolls is also formed with diametrically opposite ribs 192 which extend longitudinally between ribs 190.

In operation each of the three hoppers are filled with different products. In the illustrated embodiment the hopper associated with cavity 66 contains sugar, that associated with cavity 78 contains salt and that associated with cavity 140 contains powdered cream. The chain drives 44, 42 are synchronized with cam 26 to operate the upper and lower blades for the metering cavities and trap door 160 in the desired manner to form, fill and seal an individual packet on each of the three sections of the sealing rolls.

When support plate 14 is at top dead center a strip of packaging film 193 is automatically directed to a position of overlying the two sealing rolls 188. Strip 193 is preferably plastic coated on its top face so that it can be heat sealed, in which case sealing rolls 188 are internally heated. At this point in the cycle the upper knife blades 82, 86 are open, the bottom knife blades 84, 88 are closed and the trap door 160 is also closed. At about 90° after top dead center the bottom knife blades start opening and the top knife blades close. The two cam tracks on cams 90, 92 are oriented relative to each other such that one set of blades closes at least shortly before the other set of blades open. Also on the downstroke of support plate 14 auger 146 is operated to discharge a predetermined amount of powdered cream into cavity 140. Thus on the downstroke of support plate 14 a metered amount of product is discharged from each cavity 66, 76, 140 into the discharge chutes 152 and held therein by trap door 160.

Figure 6:
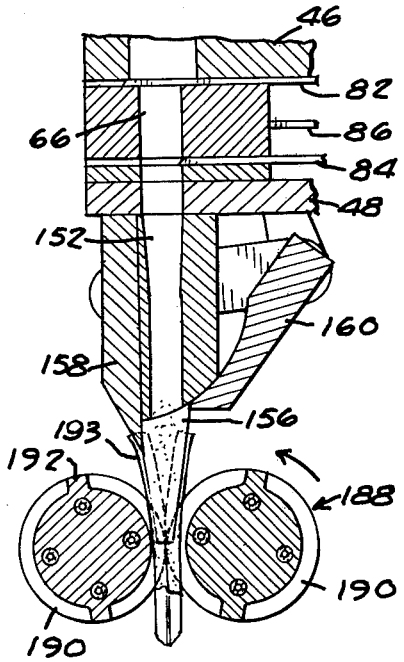
FIGS. 6 and 7 are fragmentary views similar to FIG. 5 and showing successive steps in the operation of the machine.

At the same time, as shown in FIG. 5 fingers 156 engage the strip of packaging film 193 and starts to fold it into a V-shaped trough by reason of its engagement with ribs 190 of sealing rolls 188. At about 20° before bottom dead center trap door 160 opens and the product in each of the discharge chutes 152 is discharged into each of the receptacles formed between folded film 193 and the pairs of fingers 156 associated with each of the cavities. This is illustrated in FIG. 6. At the same time it will be noted that the circumferential ribs 190 press the opposite sides of strip 193 of packing film into intimate contact along seams located laterally outwardly of each pair of fingers 156. When support plate 114 reaches bottom dead center position, trap door 160 closes and on the upstroke of plate 114 top blades 82, 86 open and the bottom blades 84, 88 close so that each of the three cavities again becomes filled with a metered amount of product.

As shown in FIG. 7 the longitudinally extending ribs 192 on sealing rolls 188 are adapted to form a top seal across the upper edge of each package being formed. Thus the arrangement described will produce a composite package 194 which comprises three individual packets 196, 198 and 200, each of different sizes and each containing different amounts of different products. If desired circular knife 202 blades may be arranged on the sealing rolls to sever packages 196, 198, 200 from each other along the lines 204.

I claim:

1. In a packaging machine of the type wherein product to be packaged is discharged into a metering cavity and then dispensed into an envelope formed to enclose the dispensed product, the combination comprising a plate member on the machine having a plurality of vertically extending cavities formed therein and arranged in a horizontally extending straight row, said cavities having an inlet adjacent their upper ends and an outlet adjacent their lower ends, at least one of said cavities having a vertical dimension between its inlet and outlet greater than another cavity whereby to define cavities of at least two different sizes, means individual to each cavity and extending downwardly to the upper end thereof for feeding product into the cavities, a blade at the outlet of each cavity reciprocable in a horizontal plane such that one end thereof is adapted to open and close said outlet, a blade at the inlet of each cavity reciprocable in a horizontal plane such that one end thereof is adapted to open and close said inlet, a pair of cross bars extending generally parallel to said row of cavities at one side thereof, each of said inlet blades having its other end mounted on one of said cross bars for movement therewith, each of said outlet blades having its other end mounted on the other cross bar for movement therewith, means supporting said cross bars for reciprocation in a horizontal plane toward and away from said cavities and means for alternately reciprocating said cross bars such that the inlets of the cavities are first opened to fill the cavities with product from said feed means to a level above the inlets, the inlets of said cavities are then closed to trap a metered charge of said product in each cavity, the outlets are then opened to discharge by gravity the metered charge of the product, the outlets are then closed and the cycle is then repeated, an additional cavity in said plate member extending downwardly therethrough, a vertically extending feed auger having its lower end positioned at the upper end of said additional cavity, means for feeding product to the auger so that when the auger is rotated the product is discharged into said cavity and means for rotating the auger through a predetermined angular extent in timed relation with the opening of the outlets of said first-mentioned cavities whereby to discharge a metered amount of product into said additional cavity upon each actuation of the auger.

2. In a packaging machine of the type wherein product to be packaged is fed downwardly into a plurality of cavities arranged in a horizontal row on a vertically reciprocating head, each cavity having an inlet at its upper end and an outlet at its lower end, a pair of vertically spaced blades associated with each cavity, means for alternately reciprocating the upper and lower blades in a horizontal plane in synchronism with vertical reciprocation of said head so that the inlets are open and the outlets are closed when the head rises and the inlets are closed and the outlets are open when the head lowers, said head being provided with a pair of abutments straddling each outlet so that when the head is lowered the abutments engage a strip of packaging material of uniform width lengthwise overlying a pair of sealing rolls vertically aligned with the abutments, fold the strip lengthwise into a trough-shaped receptacle which is divided into separate compartments by said pairs of abutments, and direct the folded strip downwardly between the sealing rolls as the product is discharged into said compartments to form a row of individual packages, said sealing rolls having circumferentially extending ribs thereon aligned with the spaces between the pairs of abutments for sealing the side edges of the successive packages and having longitudinally extending ribs thereon for sealing the end edges of the packages, that improvement which comprises means individual to each cavity and extending downwardly to the inlet thereof for feeding discrete product into each cavity, at least one of said cavities having a vertical dimension between its inlet and outlet greater than another cavity, said cavity of greater vertical dimension having a cross section at least as large as the cross section of the other cavity so that the cavity of greater vertical dimension is larger than the other cavity, the abutments associated with said larger cavity being spaced apart a greater distance than the abutments of the other cavity so as to form a larger compartment therebetween and the circumferentially extending ribs defining the side edges of the package associated with the larger cavity being spaced apart a greater distance than the circumferentially extending ribs defining the side edges of the package associated with the other cavity so that the packages in said row are of the same length but different widths.

3. The combination called for in claim 2 wherein said head comprises a pair of plate members spaced vertically apart in fixed relation and having a row of vertically aligned apertures therein, spacer means extending vertically between said plate members, said spacer means having openings extending vertically therethrough which register with the openings in said plate members, said spacer means having a pair of horizontally extending vertically spaced slots intersecting each of the openings therein, each of said plates having one end thereof slideably arranged in said slots, said cavities being defined by the portion of each opening in the spacer means which extends vertically between the upper and lower slots therein.

4. The combination called for in claim 3 including a pair of cross bars extending parallel to said row of cavities, the opposite ends of said blades being fixedly mounted on said cross bars, a guide block fixedly connected to each of the opposite ends of each cross bar, means fixed on said head and slideably engaging said guide blocks for reciprocation toward and away from said row of cavities, said means for alternately reciprocating said blades being connected to said cross bars.

5. The combination called for in claim 4 wherein said guide blocks are located in substantially the same horizontal plane, the guide blocks on one of said cross bars being located between the guide blocks on the other cross bar.

6. The combination called for in claim 5 wherein the blade for the inlet of said one cavity lies in a plane above the blade for the inlet of another cavity and including vertical spacer means extending between and connecting said other end of at least one of the inlet blades and one of said cross bars to accommodate for the difference in vertical spacing between the inlets of different cavities.

7. The combination called for in claim 6 wherein the means for reciprocating said blades comprises a pair of levers pivotally supported on said head for oscillation about a fixed horizontal axis, and a pair of links each pivotally connected at one end to one of said levers and pivotally connected at the other end with one of said cross bars.

8. In a packaging machine of the type wherein product to be packaged is discharged into a metering cavity and then dispensed into an envelope formed to enclose the dispensed product, the combination comprising a plate member on the machine having a plurality of vertically extending cavities therein arranged in a horizontally extending row, said cavities having an inlet adjacent their upper ends and an outlet adjacent their lower ends, a blade at the outlet of each cavity reciprocable in a horizontal plane to open and close said outlet, a blade at the inlet of each cavity reciprocable in a horizontal plane to open and close said inlet, means for alternately reciprocating said blades such that the inlets of the cavities are first opened to fill the cavity with product to a level above the inlets, the inlets are then closed to trap a metered charge of said product in each cavity, the outlets are then opened to discharge by gravity the metered charge of the product and the outlets are then closed, and including an additional cavity in said plate member extending downwardly therethrough, a vertically extending feed auger having its lower end positioned at the upper end of said additional cavity, means for feeding product to the auger so that when the auger is rotated the product is discharged into said cavity and means for rotating the auger through a predetermined angular extent in timed relation with the opening of the outlets of said first-mentioned cavities whereby to discharge a metered amount of product into said additional cavity upon each actuation of the auger.

* * * * *